US005662333A

United States Patent [19]

Allen

[11] Patent Number: 5,662,333

[45] Date of Patent: Sep. 2, 1997

[54] MISSILE DETECTION AND LOCATION

[75] Inventor: John Allen, Southsea, England

[73] Assignee: Paramount Technologies, Inc., Chicago, Ill.

[21] Appl. No.: 586,773

[22] PCT Filed: Jul. 27, 1994

[86] PCT No.: PCT/GB94/01619

§ 371 Date: Jan. 29, 1996

§ 102(e) Date: Jan. 29, 1996

[87] PCT Pub. No.: WO95/04251

PCT Pub. Date: Feb. 9, 1995

[30] Foreign Application Priority Data

Jul. 31, 1993 [GB] United Kingdom ..... 9315904

[51] Int. Cl.[6] ..... F41J 3/02; A63B 71/00

[52] U.S. Cl. ..... 273/371; 273/358; 273/455; 273/DIG. 26; 463/30; 463/1; 473/416; 473/570; 473/578

[58] Field of Search ..... 273/317, 348, 273/371, 372, 373, 374, 375, 376, 378, 381, 382, 383, 402, 404, 408, 236, 237, 283, 358, 454, 455; 463/36, 5, 1; 473/578; 364/410, 411

[56] References Cited

U.S. PATENT DOCUMENTS

| | | | |
|---|---|---|---|
| 3,112,110 | 11/1963 | Schulman . | |
| 3,578,327 | 5/1971 | Pickell et al. | 273/402 |
| 4,057,251 | 11/1977 | Jones et al. | 273/408 |
| 4,244,583 | 1/1981 | Wood et al. | 273/373 |
| 4,398,724 | 8/1983 | Wilson et al. | 273/411 |
| 4,561,660 | 12/1985 | Zammuto | 273/376 |
| 4,586,716 | 5/1986 | Brejcha et al. | 273/376 |
| 4,678,194 | 7/1987 | Bowyer et al. | 273/373 |
| 4,768,789 | 9/1988 | Clark | 273/371 |
| 4,813,682 | 3/1989 | Okada | 463/5 |
| 4,824,121 | 4/1989 | Beall et al. | 463/36 |
| 4,974,857 | 12/1990 | Beall et al. | 273/371 |
| 5,156,643 | 10/1992 | Grubek | 463/36 |
| 5,209,491 | 5/1993 | Dodge | 273/371 |
| 5,328,190 | 7/1994 | Dart et al. | 273/371 |

FOREIGN PATENT DOCUMENTS

| | | |
|---|---|---|
| 8806580 | 12/1988 | Germany . |
| 2030877 | 4/1980 | United Kingdom . |
| 2086243 | 5/1982 | United Kingdom . |
| WO8301904 | 6/1983 | WIPO . |
| WO8401618 | 4/1984 | WIPO . |
| WO8900066 | 1/1989 | WIPO . |
| WO9200125 | 1/1992 | WIPO . |

*Primary Examiner*—Jessica Harrison
*Assistant Examiner*—Mark A. Sager
*Attorney, Agent, or Firm*—Lockwood, Alex, Fitzgibbon & Cummings

[57] ABSTRACT

Electronic detection and location of missiles, such as darts, are disclosed in which either ambient electromagnetic noise or specifically transmitted electromagnetic impressed signals are altered by interference from the missile, and this change is detected to detect the missile and its location. The material of the target area into which the missile is embedded is electrically nonconductive.

30 Claims, 4 Drawing Sheets

MISSILE DETECTION AND LOCATION

TECHNICAL FIELD

This invention relates to the electronically monitored detection of darts or other missiles, entering or being present in a target, such as a conventional fiber or bristle dartboard or other target board.

BACKGROUND

In the past dart detection and location systems and methods have relied upon an identifiable electromagnetic signal or signals which is transmitted between two antennae, one of which is one of a plurality of electrically isolated areas of the target and the other is a conventional wire or rod. One of these antennae is electrically connected to a signal generating or transmitting (transmit) circuit, and other of these antennae is connected to a signal detecting (or receiving) circuit.

Essential to these prior methods and systems is that each target area must be rendered electrically conductive and must be electrically insulated from adjacent target areas so that a dart or other such missile which becomes embedded in the conductive target area material becomes electrically connected to a circuit unique to that target area.

When a dart becomes embedded into the target, it forms an extension to the antenna so formed by the target area, whether it be transmitting or receiving, and thereby improves the efficiency of the electromagnetic link and results in an increase of the identifiable signal at the target area, by which means the presence of the missile may be detected.

This arrangement suffers from the disadvantages that the target assembly is necessarily complex, suffering from the need to maintain a high degree of uniformity of conductivity of the target areas, a high degree of integrity of the electrical connections and a high degree of integrity of electrical isolation between the discrete target areas, requiring the use of expensive, specially constructed targets. Moreover, the fibers or other material which form the target area into which the missile is embedded must essentially be made conductive to the flow of electricity which has many disadvantages.

Another disadvantage is that these prior methods and systems cannot generally be used with missiles in which the portion of the missile which embeds into the conductive material of the target area is itself electrically nonconductive. In this case there would be no conductive link between any conductive material which may be in the missile body and which might function as an antenna and the conductive material of the target area. Thus, the prior methods and systems are generally inoperative were plastic or other nonconductive soft tipped darts are used. Some jurisdictions have mandated the use of soft tipped darts and, even where they are not mandated, they may be preferred from the safety standpoint.

SUMMARY OF THE INVENTION

One of the objects of the present invention is to enable widely available, conventionally manufactured targets to be used in automatic detection and location systems.

Another object of the invention is to obviate the need for a stable, identifiable electromagnetic signal source.

Still another object of the invention is to obviate the need for a dart or other missile to be electrically connected to the electronic circuitry or the need to make electrical connections from or to the material in the target areas and hence to obviate the need for the target material to be conductive to the flow of electrical current.

Still another object of the invention is to make possible the use of either conductive tipped or nonconductive soft or plastic tipped missiles or darts in conjunction with an automatic detection and location method or system.

One principal aspect of the present invention relies upon the fact that at locations where a target board, such as an automatic dart or similar mechanism may be installed, there will exist in the surrounding ether electromagnetic radiation or "noise" which is of a useful magnitude to irradiate, bathe and illuminate all points on the target surface at any instance in time. This radiation or "noise" may emanate from any one or more of a number of natural and/or man-made sources, such as nearby electrically powered equipment, lighting and the like. In the invention, provision is made for detecting such noise by electronic/computer circuitry which is shielded from the noise on all sides, except through the target, and which has a separate receiving sensor located behind each designated target area. Each sensor is able to detect a change or a disturbance in the characteristics of the noise which is effected by the close proximity of a physical mass, such as the body of a dart or other such missile.

Each sensor is located such that it will detect the greatest electromagnetic disturbance when a missile is closer to, located in or moves into close proximity to a given target area. The effect of this disturbance is then passed on to an electronic computing system based upon high speed data capture and relative comparison techniques, by which means the presence of the missile and its location with respect to the target may be deduced.

Conveniently, but not essentially, the circuitry may be equipped with a variable filter for the purpose of selecting any advantageous portion of the prevailing noise spectrum and discriminating against other portions thereof.

In another principal aspect of the present invention, where the ambient radiation or noise levels may be insufficient to result in a change or disturbance in the noise of a sufficient magnitude to permit consistent detection and location of the missile, or where the missile has only nominal amounts of electromagnetically responsive materials in it and/or may be soft or plastic tipped with a nonelectromagnetically responsive material, an additional signal source may be provided at or proximate to the target. The signal from this source may be employed to supplement the ambient noise or it may transmit a specific electromagnetic signal of sufficient strength to be utilized in the automatic sensing to produce consistent results.

In contrast to the aforementioned prior art the present invention provides for the simultaneous sampling of all of the individual target areas, and removes any dependence upon absolute signal levels or signal stability. Instead it relies solely upon the relative effects of interference with the noise or signal affected by the close proximity, rather than electrical connection of a missile, such as a dart, with the sensing circuitry.

BRIEF DESCRIPTION OF THE DRAWINGS

In the course of this description, reference will be made to the drawings in which.

DESCRIPTION OF THE PREFERRED EMBODIMENTS

Figure 1:
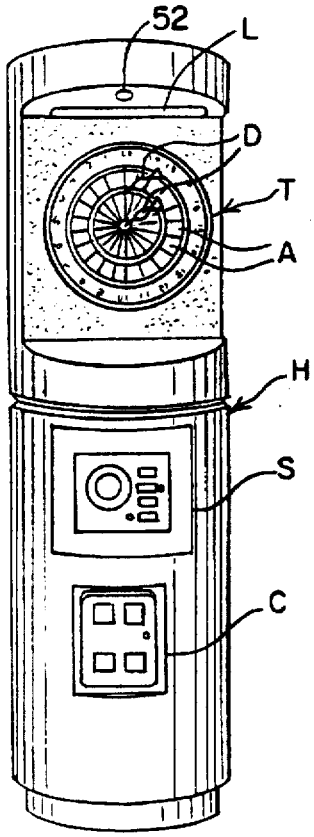
FIG. 1 shows a target arrangement for a dart game having a plurality of target areas which are assigned different score values, and in which the missile detection and location of the present invention may be incorporated.

The present invention relates to the detection and location of a missile or projectile relative to a target. As shown in FIG. 1, the target T may be a dartboard which is mounted on a housing or stand H, and which has a plurality of target areas A which have preselected differing values. The housing H may house the electronic circuitry to be described later for processing the sensed signals which are indicative of the location of the darts D which have been embedded in target areas of the dartboard T, and which compute an ongoing score for the dart game being played. The housing H may also have a display screen S, such as a cathode tube, for displaying the score, and a coin receiving mechanism C for receiving coins to initiate play of the game. In addition, a light L may be provided to illuminate the target for visibility.

Although a dartboard is described as an example of a target in which the missile detection and location of the present invention may be utilized, it is not intended that the present invention be limited to use solely with a dart game or board. It will be appreciated that the present invention may enjoy widespread use in other games which employ some form of target and missile, such as archery.

Figure 2:
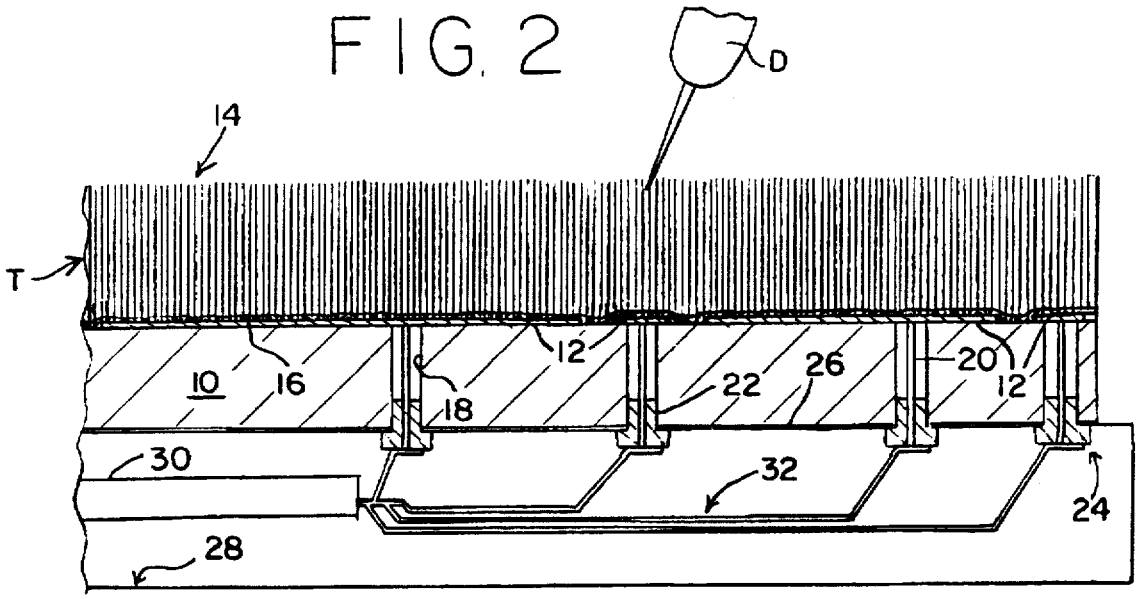
FIG. 2 shows a partial cross-section of the dartboard shown in FIG. 1 through several of the target areas of the dartboard, and one preferred embodiment of a signal sensing arrangement.

Referring to FIG. 2, one preferred embodiment of target sensing arrangement is shown for detecting and sensing the location of a dart D which comes into close proximity to or has become embedded in the dartboard T. As shown, the dartboard T preferably comprises a base board 10 of a suitable insulative material, such as a composite or chipboard. On the side of the base board 10 toward the face of the target T, conductive signal pickup elements or strips 12 are selectively located beneath each discrete target area A. The conductive elements 12 may comprise thin plates of a conductive sheet metal which are adhered to the base board 10, or preferably they are formed by coating or painting them on the base board 10. As shown in FIG. 2, each adjacent element 12 of a given target area is spaced slightly by a gap 13 so that adjacent elements of adjacent target areas are electrically separated from each other.

Fibers or bristles 14, which are typically employed to form the face of a conventional dartboard, are affixed to the face of the base board 10 on the target side and/or to the conductive sensing elements 12 by a nonconductive glue 16. Holes 18 are formed in the base board 10, one for each of the conductive elements 12, so that an electrical conductor 20 may be coupled with the conductive pickup elements 12.

The conductors 20 extend from the elements 12 through to the side of the base board 10 opposite the target face, and are protected by an insulator 22 to form signal contacts 24. The elements 12 and conductors 20 thereby form receivers for receiving either the ambient noise signals and/or any electromagnetic signals which may be specifically generated for use in the sensing function of the present invention.

With the exception of where the rear of the base board 10 is pierced by the holes 18 and insulators 22 at the signal contacts 24, the whole of the rear of the base board 10 is preferably covered by an electrically conductive paint or film 26 which forms a ground plane. The film 26 is part of an electrically grounded Faraday cage 28 which encapsulates the whole of the electronic assembly 30 so that only signals detected by the elements 12 are able to reach the circuitry. The signals from the signal contacts 24 are preferably led to the electronic circuitry 30 shown in FIGS. 6 and 7 by spring contact wires 32.

Figure 3:
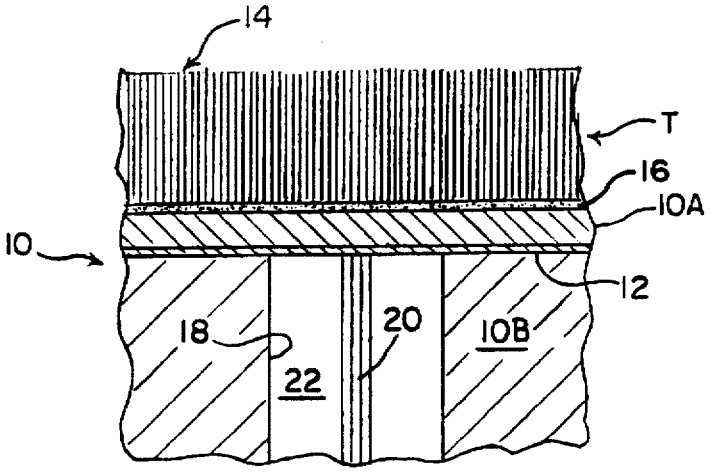
FIG. 3 shows a partial cross-section of the dartboard shown in FIG. 1, but a second preferred embodiment of signal sensing arrangement.

Referring to FIG. 3, an alternative embodiment is shown for the placement of the signal pickup elements 12. In this embodiment a completed ordinary commercially available dartboard may be modified for the purpose of the present invention by slicing and cross-sectioning its original base board 10 into two discs 10A and 10B. The typical commercially available dartboard base boards are approximately 15 mm in thickness. When sliced as shown in FIG. 3, disc 10A with the bristles 14 thereon will preferably be about 3 mm in thickness, and the disc 10B about 12 mm in thickness. In this embodiment the signal pickup elements 12 are painted or otherwise fixed to the rear face of disc 10A as shown in FIG. 3, and the holes 18 are drilled through the remainder of the base board 10B. The insulators 22 and conductors 20 are positioned as shown in FIG. 3, and the two parts 10A and 10B of the original base board 10 are then reaffixed together again, such as by an adhesive.

Figure 4:
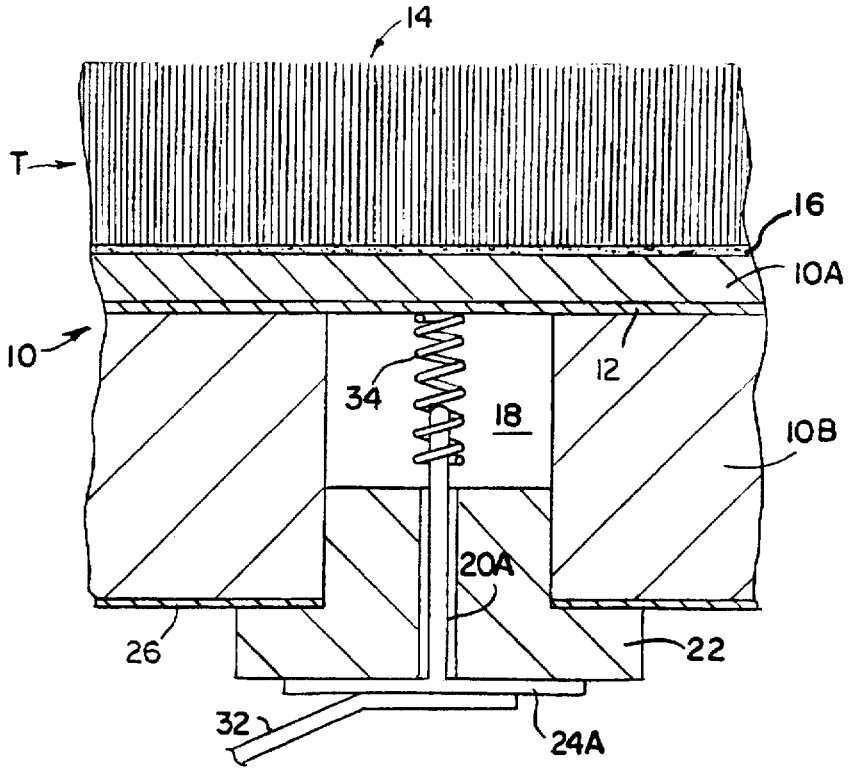
FIG. 4 shows a partial cross-section of the dartboard similar to FIG. 3, but a third preferred embodiment of a signal sensing arrangement.

Referring to FIG. 4, another preferred embodiment of assembly is shown for conducting the signals sensed by the signal pickup elements 12 through the base board 10. In the embodiment shown in FIG. 4 the split cross-sectioned disc construction of the base board of a conventional dartboard is as shown as in FIG. 3 in which the signal pickup elements 12 are fixed to the rear side of the thinner disc 10A. In this embodiment the insulator 22 is positioned in the hole 18 in the thicker disc portion 10B, and the connector in the form of a contact pin 20A extends through the insulator 22, but short of direct contact with the element 12. A conductive spring 34 extends between the contact pin 20A and the signal pickup element 12 to complete the electrical circuit for transmission of the signals from the element 12 to the contact 24A.

Figure 5:
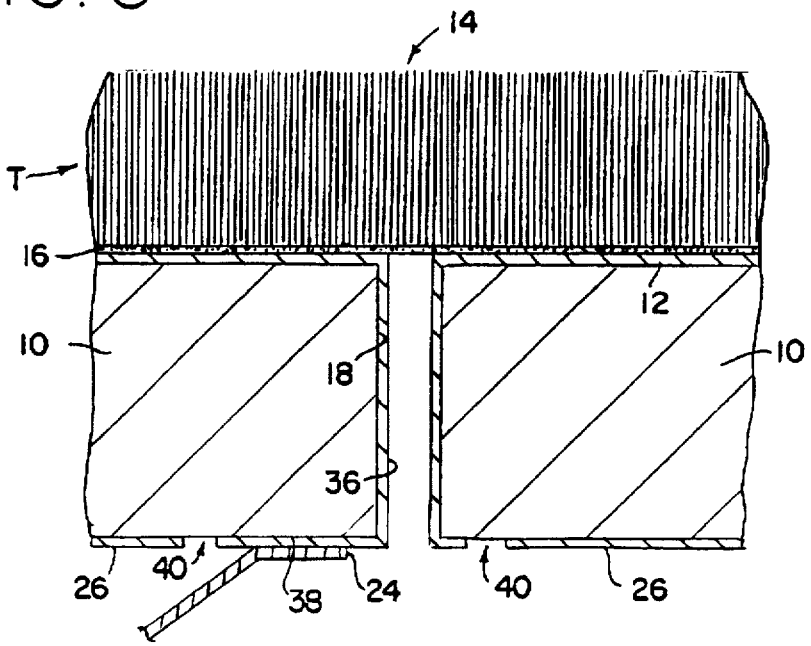
FIG. 5 shows a partial cross-section of the dartboard similar to FIG. 2, but a fourth preferred embodiment of a signal sensing arrangement.

Referring to FIG. 5, another preferred embodiment of assembly is shown for conducting the signals sensed by the signal pickup elements through the base board 10. In the embodiment shown in FIG. 5, the signal pickup element 12 is coated or painted onto the target face side of the base board 10 and the bristles 14 are adhered to it by a suitable adhesive 16. Instead of the conductors in the prior embodiments, the pickup element conductive coating is continued down through the hole 18 in the base board 10 to form a conductor 36, and the coating is further continued outward from the hole 18 at the rear face of base board to provide a contact surface 38 for the signal contact 24. The coated contact surface 38 is terminated so as to form a small gap 40 between it and the conductive coating 26 which defines a part of the Faraday cage to electrically isolate the conductive coating 26 from the conductor 36 and contact surface 38.

In each of the embodiments shown in FIGS. 2–5 a significant feature of the present invention is that the bristles 14 into which the dart D is to be embedded need not be, and in fact are not electrically conductive. This nonconductivity of the bristles results in several important advantages of the present invention. In the first instance conventional dartboards in which the bristles are not typically conductive may be used in the present invention to substantially reduce the cost. Moreover, the coating or otherwise treating of the bristles to make them conductive, as is necessary in the prior art in order for their sensing systems to properly function, is avoided. This results not only in eliminating the substantial expense for such coatings, but also the operative lifetime of the dartboards of the present invention is substantially increased because the conductive bristles of the prior art tended to lose their optimum conductivity over time due to repeated impact from the darts. Also the need for carefully constructed insulative barriers between the various conductive target areas is avoided in the present invention. This permits the use of conventional dartboards and avoids the cost of such barriers. It also avoids one of the problems of the prior art due to the penetration of these insulative barriers by the dart tip after repeated usage, which results in breakdown in the integrity of the insulative barriers and malfunction. Due to the fact that the bristles need not be and are not conductive in the present invention, the bristles of adjacent target areas need not be electrically insulated from each other.

Figure 6:
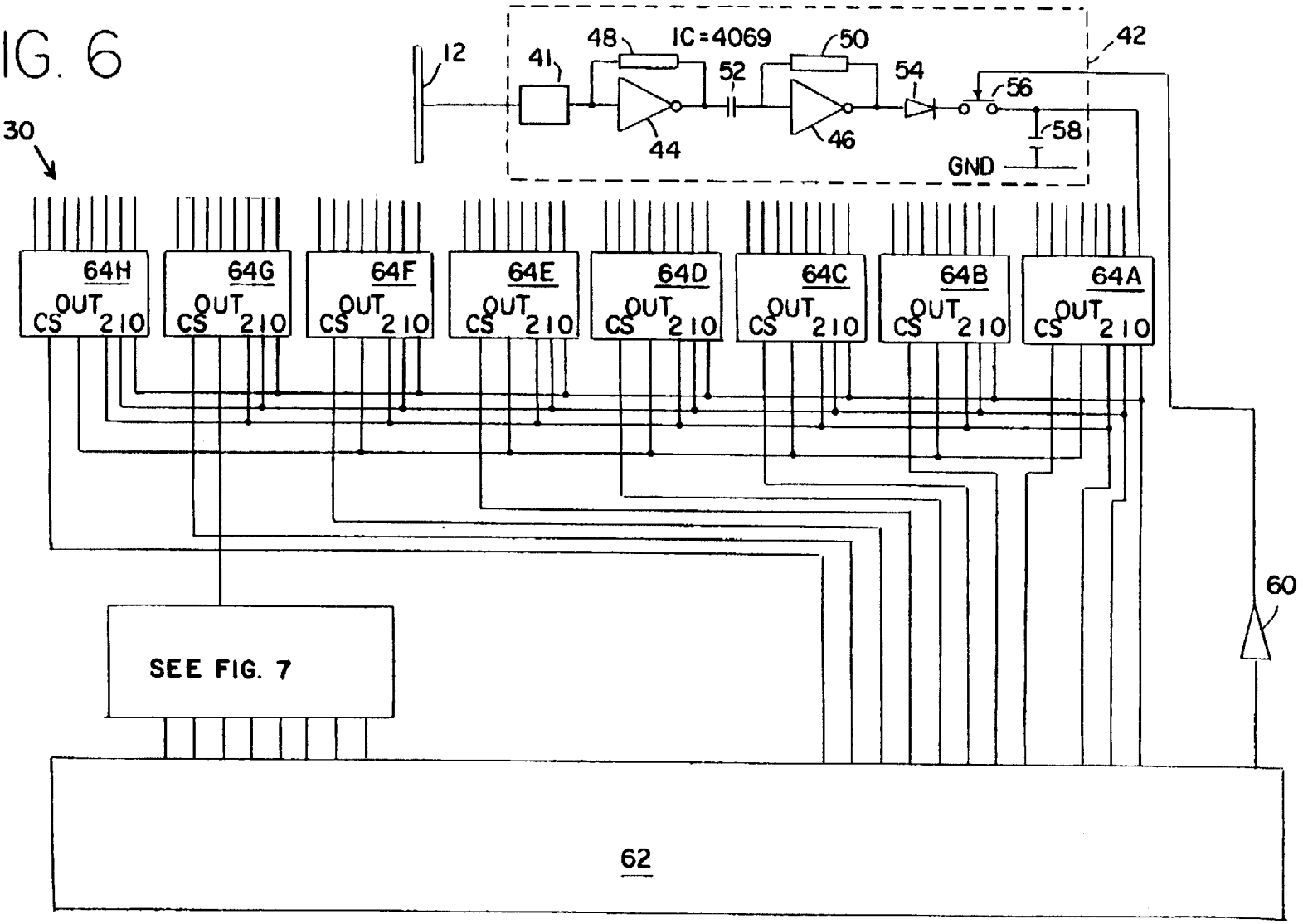
FIGS. 6 and 7 show a suitable electronic circuit for receiving and processing the signals sensed by the signal sensing embodiments of FIGS. 2–5.
Figure 7:
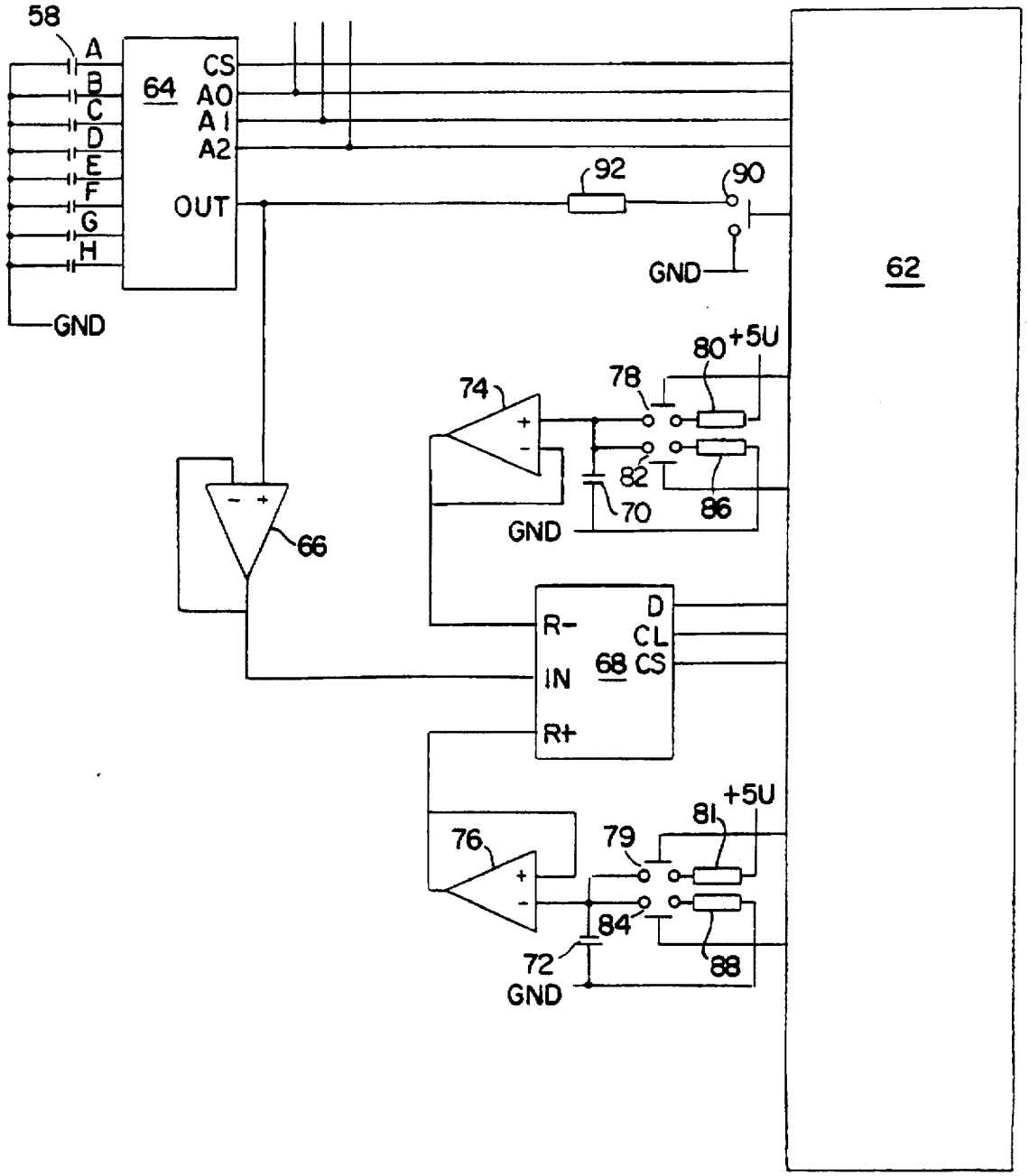

Referring to FIGS. 6 and 7, a suitable electronic signal receiving and processing circuit 30, as seen in FIG. 2, is shown by which the signals from each of the signal pickup elements 12 are processed. It will be appreciated that there will be a sensing element 12 for each of the target areas, but only one has been shown in FIG. 6 for simplicity.

Each of the respective signal pickup elements 12 which are located behind and in close alignment with the designated target areas of the dartboard, is directly connected to a filter 41, if it is desired to only sense a portion of the electromagnetic spectrum, and to a two stage amplifier-sample and hold circuit 42. In the case of a dartboard there will be sixty three target areas A, elements 12 and amplifiers-sample and hold circuits 42. The amplifier shown is preferably suitable either for the utilization of low frequency of about 50 or 60 Hz ambient noise, or specifically generated signals up and including the telemetry band of about 150 KHz. Each amplifier preferably includes two CMOS inverting gain stages 44 and 46 which are biased into a linear operating mode by resistors 48 and 50, and are coupled by capacitor 52.

The resulting signal is next passed through a diode 54 to an electronic switch 56, and then to a low loss storage capacitor 58. When switch 56 is turned on, the positive excursions of the amplified signal will "pump" up the voltage on the capacitor 58, effectively "recording" the peak voltage as a charge on the capacitor. When the switch 56 is turned off, the charge will be held by the capacitor until discharged by the following circuitry. All of the switches 56 for each of the signal pickup elements 12 are turned on and off at the same time by a buffer amplifier 60 under the control of a microprocessor 62.

Thus, irrespective of the absolute value of the source signal at the point of sampling, the relationship between the resulting stored charges will be a constant, except when an event interferes with the received signal so that the individual target pickup elements 12 are not uniformly affected. This will occur for example, when a missile is in close proximity to one of the target areas A and its signal pickup element 12 so as to interfere with the signal.

In the case of a dartboard where there are sixty three target areas A and elements 12, each of the sixty three charge storage capacitors 58 for each target area is singly connected to an input of a 63 to 1 signal routing circuit comprising eight off 8 to 1 electronic switching devices 64A–64H. Under the control of the microprocessor 62, each of the samples is passed to the signal processing circuit shown in FIG. 7.

For simplicity, FIG. 7 shows eight of the sixty three storage capacitors 58A–58H connected to one of the eight electronic switch blocks 64A–64H. The voltage resulting from the charge on each of the capacitors 58 is singly passed to a convenient high impedance buffer amplifier 66, the output of which is taken to an analog to digital converter 68 which converts the voltage into a digitally encoded value which is equivalent to the analog voltage value, and which is suitable for processing by the digital microprocessor 62.

The derived digital value is not an absolute value, but is equivalent to the ratio of the derived voltage and two reference voltages (one more negative than the sample and one more positive than the sample) which are also applied to the analog to digital converter 68. These reference voltages are determined by the charges held in the capacitors 70 (negative ref.) and 72 (positive ref.), buffered by high impedance amplifiers 74 and 76 respectively, and determined by the microprocessor 62 by the following actions. When the electronic switches 78 and/or 79 are turned on by the processor 62, a charge is allowed to build up on the capacitors 70 and/or 72, via the resistors 80 and/or 81. The voltage resulting from this will be proportional to the length of time for which the processor 62 holds the switches 78 and/or 79 in the on state. Thus, the processor 62 is able to set the reference voltage to suit the prevailing conditions.

By this means, not only is the analog to digital converter 68 used to perform the conversion, it is also caused to function as a variable gain amplifier under the control of the program held in the processor 62.

The electronic switches 82 and 84 are used to discharge the reference capacitors 70 and 72 via the current limiting resistors 86 and 88.

Finally, the electronic switch 90 is used to discharge each of the sixty three storage capacitors 58 via the current limiting resistor 92.

The microprocessor 62 controls the duration of the sample period as a way to maintain workable signal levels. The microprocessor 62 is able to repeatedly store and compare the signals in a well known manner, and so detect any changes which may be due to the close proximity of an object, such as the missile or dart D, which interferes with or disturbs the noise which the target area otherwise receives by the use of conventional auto and cross correlation techniques. The microprocessor 62, once it detects the fact that a missile has been embedded in the target T and the location at which it is embedded, may score that hit, and tally the ongoing score. This score may be shown on the display S as shown in FIG. 1.

Remote sources of electromagnetic noise which might affect the perceived signals will affect all of the target areas more or less equally. Thus, despite the unpredictability of the signals, they will still provide the required detection conditions. Near events that might transiently cause the ambient noise to fall below or rise above a reasonable working level will be discounted by the microprocessor, and only darts or other non-transient close proximity objects will have an unequal effect and will thereby be positively identified.

Because the present invention operates on a principle of interference with the incoming electromagnetic signals, at least some portion of the missile should include a material which is electromagnetically responsive. In the case of typical steel tipped darts, both the tip as well as the body of the dart are usually electromagnetically responsive. In the case of soft or plastic tipped darts, the tip is generally not electromagnetically responsive (unless the plastic is coated or impregnated with such material), but the body is. Whichever darts are used, there is a sufficient amount of electromagnetically responsive material to provide sufficient interference with the incoming signals to permit missile detection and location.

The signal interference of the invention is to be distinguished with the antennae function of the missiles in the systems of the prior art. In order to function as an antenna as in the prior art, electrical conduction of the signals was necessary between the missile and its tip and conductive elements behind the material into which the dart was embedded. Thus in the case of prior dartboards, it was necessary that the material into which the dart was to be embedded be electrically conductive. This is not necessary in the present invention because there is no such electrical conduction. In the invention, and as shown in FIG. 2, the missile tip is embedded in the target nonconductive material 14 to a depth substantially less than the depth of the nonconductive material 14, the tip is spaced from the signal sensing element 12, and the element 12 receives the signals directly which pass through the nonconductive material. The embedded missile only interferes with or disturbs the incoming signal so that the signal which is received by the element is altered from the signal which was originally received in the absence of the missile. In fact, in the present invention, the dart or other missile may actually be sensed even before it embeds in the target area, but has moved into close proximity to the target area.

Although it is believed that the operation of the detection and location system and method of the present invention will be evident to those skilled in the art from the foregoing description, a brief description of the operation will follow.

At all times the target or dartboard T will be bathed in and illuminated by ambient electromagnetic noise. This noise will pass through the dartboard material, such as the nonconductive bristles 14, and be received and sensed by the signal pickup elements 12. The sensed signal will be passed through the conductor 20, contacts 24, contact wires 32 and the electronic processing system 30. At the commencement of a game and before any missiles or darts D have been thrown, these signals will be sensed to be those of the ambient, uninterferred signals.

When a dart D moves into close proximity to a target area, or is embedded in the dartboard bristles 14 as shown in FIG. 2, any electromagnetic responsive material, such as steel, from which either or both the dart body or tip are formed, will interfere with the incoming signal that is being received by the signal pickup elements 12 in the target area in which the dart becomes embedded. This interference will disrupt and change the incoming signal which reaches the element 12 in that target area. This change or alteration will be sensed by the electronic processing system 30 to result in detection of the presence of the dart and determine its location. Once detection and location have taken place, the signal may be processed by the microprocessor to calculate the appropriate score, and that score may be displayed on the screen S, as shown in FIG. 1.

It is conceivable that under certain circumstances the ambient electromagnetic noise levels at a given location may be insufficiently low so that the magnitude of the signal change due to interference from the missile may be insufficient to permit consistent detection to the extent desired. This condition may also occur where the amount of electromagnetic responsive material in the missile D is only nominal, or if it is adequate in the missile body, the tip of the missile is formed of a soft, plastic nonelectromagnetic material. In the latter instance, the tip may result in the positioning of the electromagnetic responsive material at too great a distance from the signal pickup elements 12 which could result in a reduction in consistency of detection.

In these instances a separate signal transmitting source 52, as shown in FIG. 1, may be provided in proximity to the target T. This signal source 52 may itself generate random electromagnetic noise to supplement the existing ambient noise, or it may provide a specific electromagnetic signal which the circuitry of the present invention is specifically tuned to receive. In either case, the embodiments as previously disclosed herein may be used essentially without change, and will function the same way and in the same manner as previously described. Thus, the embodiments shown in FIGS. 2–5 need not be altered in any respect where the signal source 52 is provided.

It will be understood that the preferred embodiments of the present invention which have been described are merely illustrative of the principles of the present invention. Numerous modifications may be made by those skilled in the art without departing from the true spirit and scope of the invention.

I claim:

1. A system for detecting and locating a missile embedded in a target, comprising:

a target having a target face, said target face having a plurality of target areas formed of an electrically nonconductive material and into which material one or more of the missiles may be selectively embedded;

signal receiving elements associated with respective ones of said target areas for receiving and sensing electromagnetic signals which pass through said nonconductive material at each of said target areas from an electromagnetic signal source remote from said target areas, said signal receiving elements being positioned on a side of said nonconductive material opposite said target face; and processing means electrically connected to said signal receiving elements, said processing means distinguishing between a first electromagnetic signal which is received and sensed by one of said signal receiving elements in the absence of a missile in close proximity to said target area of said one of said signal receiving elements, and a second electromagnetic signal which results from an alteration of said first electromagnetic signal by the presence of a missile at least a portion of which is formed of an electromagnetic responsive material in close proximity to said target area of said one of said signal receiving elements, wherein the close proximity of the missile to said last mentioned target area permits the detection of the presence and location of the missile.

2. The system of claim 1, including a shield for shielding at least a portion of said processing means from all directions other than from the target face of the target.

3. The system of claim 1, wherein said processing means includes a computer for distinguishing between said first and second electromagnetic signals.

4. The system of claim 1, wherein said processing means includes simultaneous sampling and hold circuitry which examines the electromagnetic signals received by said elements at each of said target areas.

5. The system of claim 1, wherein said electrically nonconductive material into which the missile is to be embedded comprises electrically nonconductive fibers.

6. The system of claim 1, wherein said source remote from said target areas comprises an electromagnetic signal transmitter illuminating the target with said electromagnetic signals.

7. The system of claim 1, further including a said missile, said missile including a tip which is constructed to be embedded in said nonconductive material, and said tip is formed of an electromagnetic responsive material.

8. The system of claim 1, wherein said electromagnetic signals from said source remote from said target areas comprise ambient electromagnetic noise emanating from at least one said source remote from said target areas.

9. The system of claim 8, including discriminating means to select a predetermined portion of the spectrum of said ambient electromagnetic noise for said signals.

10. The system of claim 1, further including a said missile, said missile including a tip which is constructed to be embedded in said nonconductive material, and said tip is formed of a nonelectromagnetic responsive material.

11. The system of claim 10, wherein said tip is formed of plastic.

12. The system of claim 1, wherein said missile is a dart.

13. The system of claim 12, wherein said target is a dartboard and in which said which plurality of target areas which are assigned preselected values.

14. The system of claim 1, wherein said target comprises:

an electrically nonconductive base having a first side facing said target areas and a second opposite side, said electrically nonconductive material of the target areas being fixed to said first side and said signal receiving elements being positioned between said nonconductive material and said second opposite side;

electrical conductors electrically connected to respective ones of said signal receiving elements and extending through said electrically nonconductive base to said second opposite side thereof; and a contact electrically connected to said electrical conductors adjacent said second opposite side.

15. The system of claim 14, wherein said signal receiving elements are coated on said nonconductive base.

16. The system of claim 15, wherein said electrical conductors are also coated on said base and are integral with said signal receiving elements.

17. The system of claim 14, wherein each of said conductors comprise a pin extending into said base and electrically connecting said signal receiving elements and said contacts.

18. A method of detecting and locating a missile embedded in a target, comprising:

illuminating a plurality of target areas of the target with at least one electromagnetic signal from an electromagnetic signal source remote from said target areas;

passing the electromagnetic signal which illuminates the target areas through an electrically nonconductive material of the target areas;

sensing said electromagnetic signal which has passed through the nonconductive material;

altering the electromagnetic signal which passes through the nonconductive material by positioning a missile in close proximity to the material of at least one of the target areas to interfere with the electromagnetic signal which illuminates said at least one of said target areas;

sensing the altered electromagnetic signal; and processing the electromagnetic signals which have passed through the nonconductive material and have been sensed both before and after the missile has been positioned in close proximity to said at least one of said target areas to detect the presence and location of the missile.

19. The method of claim 18, wherein said processing includes sampling and holding the electromagnetic signals to examine the signals which have been sensed at each target area at the same point in time.

20. The method of claim 18, wherein said nonconductive material comprises a plurality of electrically nonconductive fibers.

21. The method of claim 18, wherein said electromagnetic signal which illuminates said target areas is ambient electromagnetic noise emanating from a source remote from said target.

22. The method of claim 21, including selecting a predetermined portion of the spectrum of said ambient electromagnetic noise for the electromagnetic signals which are sensed signals.

23. The method of claim 18, including generating and transmitting the electromagnetic signals which illuminate the target area.

24. The method of claim 18, wherein the missile which is positioned in close proximity to the nonconductive material of said at least one of the target areas is embedded in said nonconductive material.

25. The method of claim 18, wherein the missile is a dart.

26. The method of claim 25, wherein said target is a dartboard having a plurality of said target areas which are assigned preselected values.

27. The method of claim 18, wherein at least a portion of the missile is formed of an electromagnetic responsive material which interferes with the electromagnetic signal which illuminates said at least one of said target areas to alter the electromagnetic signal.

28. The method of claim 27, wherein the missile includes a tip which is embedded in the nonconductive material of the target area, and the tip is formed of an electromagnetic responsive material.

29. The method of claim 27, wherein the missile includes a tip which is embedded in the nonconductive material of the target area, and the tip is formed of a nonelectromagnetic responsive material.

30. The method of claim 29, wherein the tip is plastic.

* * * * *

UNITED STATES PATENT AND TRADEMARK OFFICE

CERTIFICATE OF CORRECTION

PATENT NO. : 5,662,333

DATED : September 2, 1997

INVENTOR(S) : John Allen

It is certified that error appears in the above-indentified patent and that said Letters Patent is hereby corrected as shown below:

Col. 9, line 24, delete "which" (second occurrence);
line 25, delete "which".
Col. 10, line 29, delete "signals"; line 32, delete "area"
and insert --areas--.

Signed and Sealed this

Thirtieth Day of March, 1999

*Attest:*

*Attesting Officer*

Q. TODD DICKINSON

*Acting Commissioner of Patents and Trademarks*